US009994033B2

(12) United States Patent
Iizawa et al.

(10) Patent No.: US 9,994,033 B2
(45) Date of Patent: Jun. 12, 2018

(54) LIQUID SUPPLY DEVICE AND LIQUID EJECTING APPARATUS

(71) Applicant: SEIKO EPSON CORPORATION, Tokyo (JP)

(72) Inventors: Keigo Iizawa, Shiojiri (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/660,526

(22) Filed: Jul. 26, 2017

(65) Prior Publication Data

US 2018/0043693 A1 Feb. 15, 2018

(30) Foreign Application Priority Data

Aug. 12, 2016 (JP) ..... 2016-158439

(51) Int. Cl.
*B41J 2/175* (2006.01)

(52) U.S. Cl.
CPC ..... *B41J 2/1752* (2013.01); *B41J 2/17596* (2013.01)

(58) Field of Classification Search
CPC .. B41J 2/17503; B41J 2/17596; B41J 2/1752; B41J 2/17523
USPC ..... 347/6
See application file for complete search history.

(56) References Cited

U.S. PATENT DOCUMENTS 5,969,735 A * 10/1999 Haigo ..... B41J 25/304 347/85
6,799,840 B2 * 10/2004 Inamura ..... B41J 2/17509 347/85
8,020,983 B2 * 9/2011 Nishimori ..... B41J 2/175 347/7
2006/0203045 A1 9/2006 Kobayashi et al.
2008/0002002 A1 * 1/2008 Takemoto ..... B41J 2/17509 347/84
2014/0253645 A1 9/2014 Tsukahara et al.
2016/0089895 A1 3/2016 Iwase et al.

FOREIGN PATENT DOCUMENTS

JP 10-193639 A 7/1998
JP 2000-158663 A 6/2000
JP 2001-030509 A 2/2001
JP 2006-021398 A 1/2006
JP 2006-212846 A 8/2006
JP 2007-160849 A 6/2007
JP 2007-290388 A 11/2007
JP 2009-202347 A 9/2009

(Continued)

*Primary Examiner* — Huan Tran
*Assistant Examiner* — Alexander D Shenderov
(74) *Attorney, Agent, or Firm* — Workman Nydegger

(57) ABSTRACT

There is provided a liquid supply device that supplies liquid to a liquid ejecting portion which ejects liquid from a nozzle, the liquid supply device including a holding portion that holds, so as to be attachable and detachable, a liquid accommodating body that accommodates the liquid, and a rotation mechanism that rotates the holding portion between an attachment and detachment position at which the liquid accommodating body is attached and detached and a supply position at which the liquid is supplied to the liquid ejecting portion, in which the liquid accommodating body that is held in the holding portion at the supply position is disposed at a higher position than the nozzle.

11 Claims, 6 Drawing Sheets

(56) References Cited

FOREIGN PATENT DOCUMENTS

| | | | |
|---|---|---|---|
| JP | 2014-188924 | A | 10/2014 |
| JP | 2015-107660 | A | 6/2015 |
| JP | 2015-112800 | A | 6/2015 |
| JP | 2016-022626 | A | 2/2016 |
| JP | 2016-068341 | A | 5/2016 |

* cited by examiner

LIQUID SUPPLY DEVICE AND LIQUID EJECTING APPARATUS

BACKGROUND

1. Technical Field

The present invention relates to a liquid supply device and a liquid ejecting apparatus.

2. Related Art

An ink jet printer that is configured such that a liquid pack is mounted on an apparatus main body that is supported on a leg portion and liquid is supplied by a water head is known as an example of the liquid ejecting apparatus (for example, JP-A-2016-22626).

It is necessary to mount a liquid pack at a high position in order to secure a water head for supplying liquid. However, there is a problem in that the higher the mounting position the larger the labor taken for attachment and detachment. Such a problem is not limited to a printer that performs printing by ejecting ink, and is generally common in a liquid supply device and liquid ejecting apparatus that supplies liquid using a water head.

SUMMARY

An advantage of some aspects of the invention is to provide a liquid supply device and a liquid ejecting apparatus which is able to reduce labor taken for attachment and detachment of a liquid accommodating body.

According to an aspect of the invention, there is provided a liquid supply device that supplies liquid to a liquid ejecting portion which ejects the liquid from a nozzle, the liquid supply device includes a holding portion that holds, so as to be attachable and detachable, a liquid accommodating body that accommodates the liquid, and a rotation mechanism that rotates the holding portion between an attachment and detachment position at which the liquid accommodating body is attached and detached and a supply position at which the liquid is supplied to the liquid ejecting portion, in which the liquid accommodating body that is held in the holding portion at the supply position is disposed at a higher position than the nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of a liquid ejecting apparatus will be described below with reference to the drawings. For example, the liquid ejecting apparatus is an ink jet printer that performs recording (printing) by ejecting ink, which is an example of liquid, on a medium such as a paper sheet.

Figure 1:
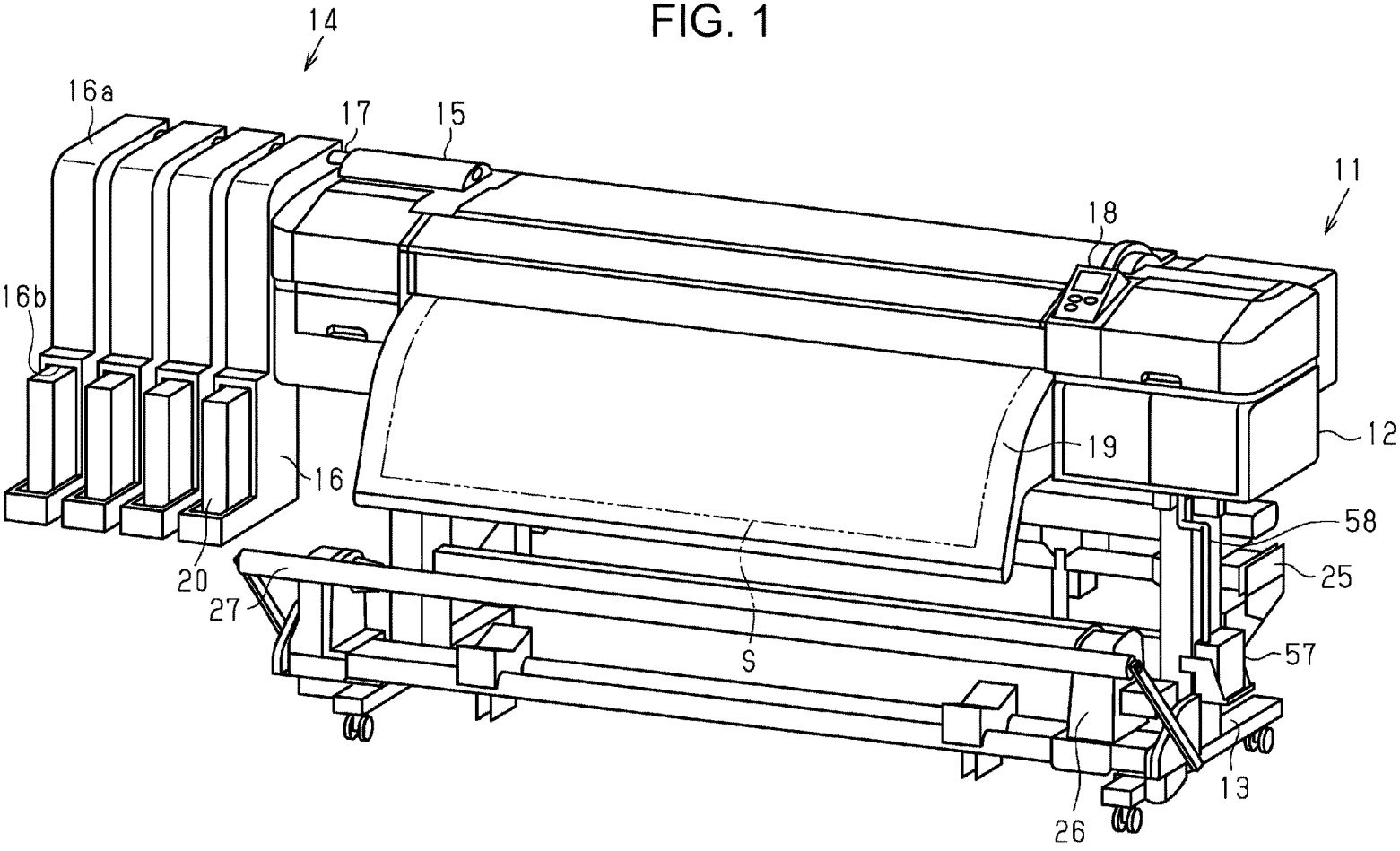
FIG. 1 is a perspective view illustrating an embodiment of a liquid ejecting apparatus that is provided with a liquid supply device.

As shown in FIG. 1, a liquid ejecting apparatus 11 of the present embodiment is a large format printer (LFP) that performs printing on a medium S of a comparatively large size, for example, JIS standards AO size, BO size, or the like.

The liquid ejecting apparatus 11 is provided with a casing 12, a support leg portion 13 that supports the casing 12, and a liquid supply device 14 that supplies liquid within the casing 12. The liquid supply device 14 is provided with a rotation mechanism 15 that is mounted in the casing 12, one or a plurality (four in the embodiment) holding portions 16 that attachably and detachably hold a liquid accommodating body 20 that accommodates the liquid, and a rotary shaft 17 that connects the rotation mechanism 15 and the holding portion 16. The holding portion 16 has an arm **16*a* that engages with the rotary shaft 17 and extends from the base end side and a box shape holder 16*b* that accommodates the liquid accommodating body 20**.

When a side at which the printed medium S comes out of the casing 12 is a front side, an operation portion 18 that performs an operation of the liquid ejecting apparatus 11 is provided on the front side of the casing 12. In addition, a support protruding portion 19 that guides the printed medium S downward while supporting protrudes from a front surface part of the casing 12.

Figure 2:
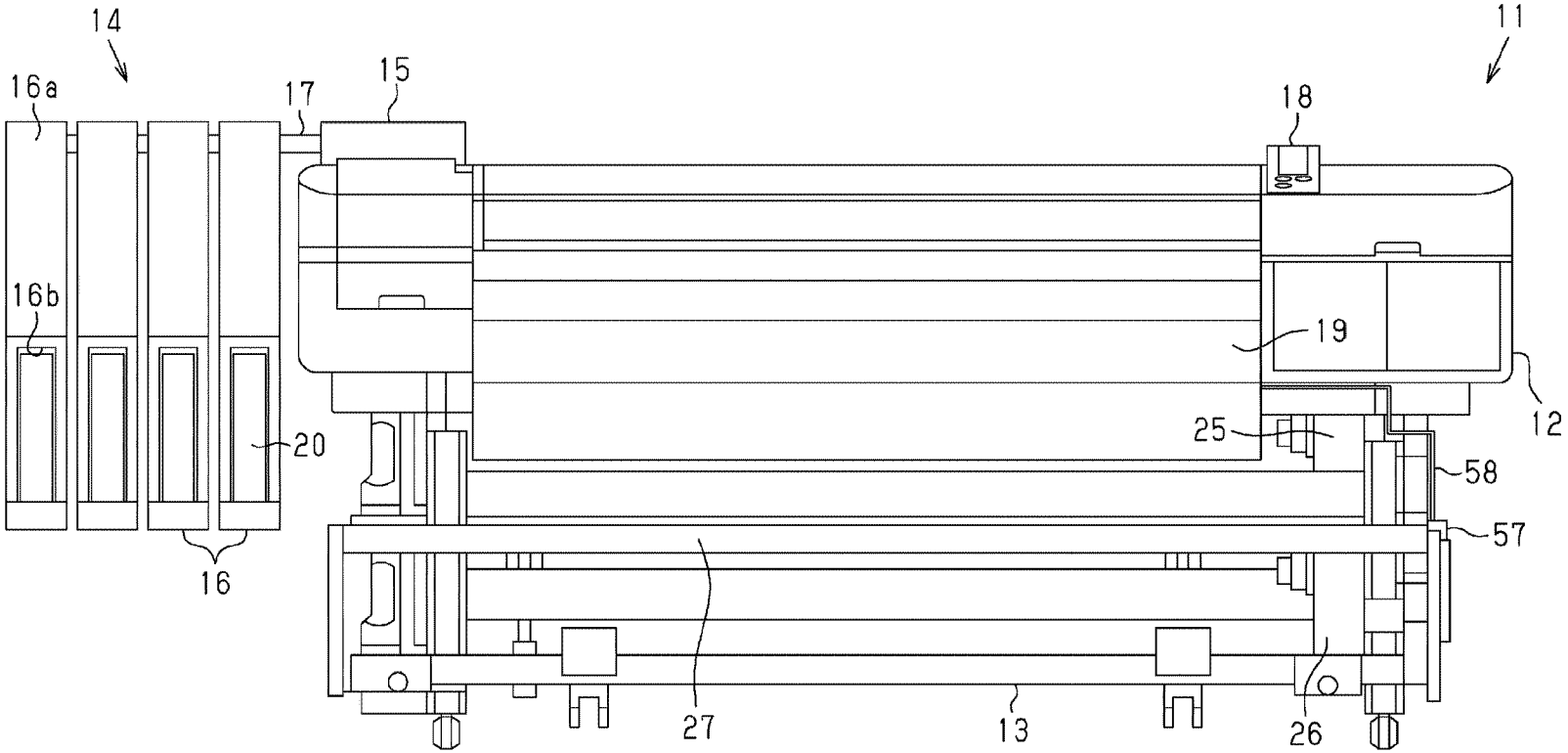
FIG. 2 is a front surface view of the liquid ejecting apparatus in FIG. 1.

As shown in FIG. 2, the casing 12 is divided into a center part in which a transport path of the medium S is disposed, such as the support protruding portion 19, and both end parts which are outside the transport path in the longitudinal direction (left and right direction in FIG. 2).

For example, the liquid supply device 14 is provided on one end side of the casing 12 in the longitudinal direction, and a plurality of holding portions 16 may be disposed lined up in the longitudinal direction of the casing 12 in a case where there are a plurality of holding portions 16. In this case, the rotary shaft 17 extending from the rotation mechanism 15 extends in the longitudinal direction of the casing 12 so as to pass through the plurality of holding portions 16.

Figure 3:
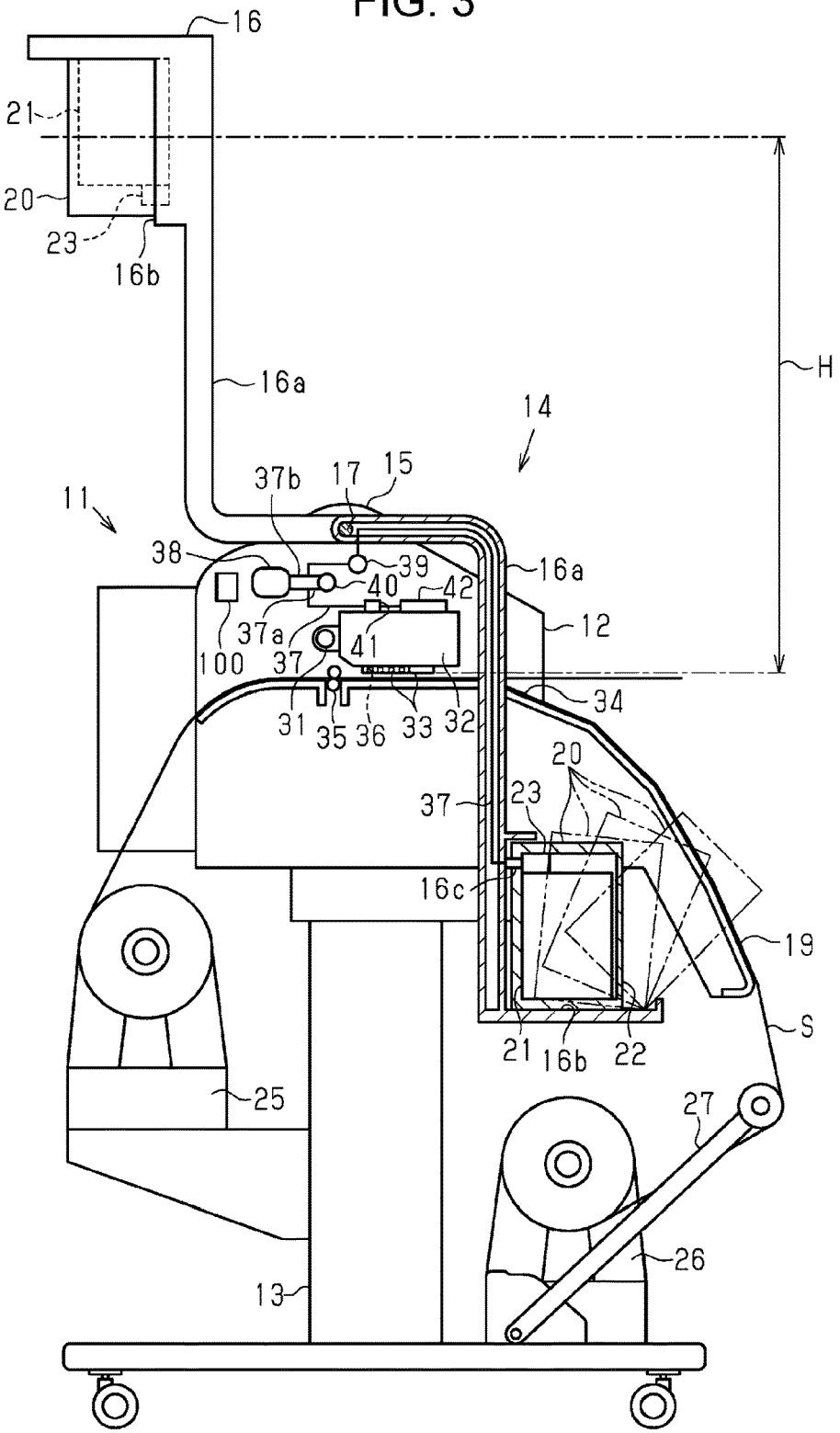
FIG. 3 is a schematic diagram illustrating the entire configuration of the liquid ejecting apparatus in FIG. 1.

As shown in FIG. 3, the liquid ejecting apparatus 11 may be provided with a feeding mechanism 25 that holds, to be rotatable, the unused medium S that is wound in a cylindrical shape (for example, a paper roll), a winding mechanism 26 that winds the printed medium S that comes out from the casing 12, and a tension bar 27 that applies tension to the medium S that comes out from the casing 12. According to this configuration, it is possible to continuously perform a recording process on a long medium S that is wound in the cylindrical shape.

A guide shaft 31 that extends in the longitudinal direction, a carriage 32 that reciprocally moves along the guide shaft 31, one or a plurality (two in the embodiment) of liquid ejecting portions 33 that are held in the carriage 32 (refer to FIG. 4), a support portion 34 that forms the transport path of the medium S within the casing 12, and a transport mechanism 35 that transports the medium S within the casing 12 are accommodated within the casing 12.

The liquid ejecting portion 33 has a plurality of nozzles 36, and performs the recording process by ejecting the liquid from a nozzle 36 toward the medium S that is transported on the support portion 34 by the transport mechanism 35. In the embodiment, the movement direction of the carriage 32 and the longitudinal direction of the casing 12 match. In addition, the transport direction of the medium S on the support portion 34 intersects with (preferably is orthogonal to) the movement direction of the carriage 32.

An introducing portion 16*c* that is connected such that it is possible to lead out the accommodated liquid is provided in the holding portion 16 with respect to the liquid accommodating body 20 that is held in the holding portion 16. In a case where the liquid accommodating body 20 has a rectangular-shaped profile, as indicated by a two-dot chain line in FIG. 3, for example, first, a lower corner may enter inside the holder 16*b* and the entirety of the liquid accommodating body 20 may be put into the holder 16*b* while inclining and rotating an upper side centered on the corner. An upstream end of the supply flow path 37 for causing liquid to flow toward the liquid ejecting portion 33 is connected to the introducing portion 16*c*. The supply flow path 37 is introduced inside the casing 12 passing inside the arm 16*a*, and the downstream side is connected to the carriage 32.

The rotation mechanism 15 rotates the holding portion 16 between an attachment and detachment position (position illustrated in a sectional view in FIG. 3) at which the liquid accommodating body 20 is attached and detached and a supply position (position illustrated in a side surface view in FIG. 3) at which the liquid is supplied to the liquid ejecting portion 33. In the embodiment, the holding portion 16 is disposed at the supply position and the attachment and detachment position by the rotation mechanism 15 rotating the holding portion 16 approximately 180 degrees centered on the rotary shaft 17. In a case where there are a plurality of holding portions 16, a plurality of holding portions 16 may be configured to individually rotate, and the plurality of holding portions 16 may be configured to collectively rotate.

For example, driving force that rotates the rotary shaft 17 using the rotation mechanism 15 may be shared with a motor provided for unwinding an unused medium S that is wound in a cylindrical shape and winding the printed medium S. Otherwise, the holding portion 16 may be configured to be rotated by hand.

The liquid accommodating body 20 that is held in the holding portion 16 at the supply position is disposed at a higher position than the nozzle 36, and the liquid accommodating body 20 that is held in the holding portion 16 at the attachment and detachment position is disposed at a lower position than the nozzle 36. The holding portion 16 at the supply position is disposed at a position to which it is possible to supply the liquid to the liquid ejecting portion 33 using a water head that is generated due to a difference of height between the liquid that is accommodated in the mounted liquid accommodating body 20 and the nozzle 36. A value of converted pressure of the water head with respect to the nozzle 36 of the liquid that is accommodated in the liquid accommodating body 20 at the supply position is larger than pressure loss that is generated when the liquid is ejected for a recording process. Note that, "water head" is substituted with liquid pressure at a height in the direction of gravity of a liquid column, and has a length dimension (for example, m). For example, the pressure is 9.8 kPa in a case where a water head of 1 m is pressure converted when the liquid is water.

For example, the liquid accommodating body 20 is a cartridge that has a liquid accommodating portion 21 that accommodates the liquid, a lead-out portion 23 that leads out the liquid from the liquid accommodating portion 21, and a case 22 that accommodates the liquid accommodating portion 21. Note that, the liquid accommodating portion 21 that is a bag having flexibility that constitutes the liquid accommodating body 20 and the lead-out portion 23 that leads out the liquid from the liquid accommodating portion 21 may be set in a tray that is attachable and detachable with respect to the holding portion 16 and the liquid accommodating body 20 may be mounted in the holding portion 16 along with the tray. When the liquid accommodating portion 21 is mounted on the holding portion 16, the lead-out portion 23 is connected to the introducing portion 16*c* so as to be in a state in which it is possible to supply the liquid through the lead-out portion 23.

In this case, preferably a positional relationship of the lead-out portion 23 and the liquid accommodating portion 21 in the liquid accommodating body 20 that is held in the holding portion 16 is inverted up and down when the holding portion 16 is at the supply position and when at the attachment and detachment position. For example, when setting such that the lead-out portion 23 is disposed below the liquid accommodating portion 21 at the supply position, the liquid that is accommodated in the liquid accommodating portion 21 tends to flow out from the lead-out portion 23 using the water head. In addition, when the lead-out portion 23 is disposed above the liquid accommodating portion 21 in the liquid accommodating body 20 that is held in the holding portion 16 at the attachment and detachment position, the liquid tends not to leak accompanying attachment and detachment of the liquid accommodating body 20.

A rotation angle at which that holding portion 16 is rotated by the rotation mechanism 15 may be smaller or larger than 180 degrees, but is preferably 90 degrees or more to 270 degrees or less in order to invert up and down the positional relationship between the lead-out portion 23 and the liquid accommodating portion 21.

Preferably the holder 16*b* surrounds the liquid accommodating body 20 such that the liquid accommodating body 20 does not drop down when the holding portion 16 is inverted up and down due to rotation. Note that, an opening for taking in and out the liquid accommodating body 20 may be provided in the holder 16*b* and a lid may be provided that covers the opening.

The liquid ejecting apparatus 11 is provided with a pressure feeding mechanism 38 that forcefully causes the liquid to flow from the liquid accommodating body 20 toward the liquid ejecting portion 33, and a control portion 100 that performs control of various mechanisms that the liquid ejecting apparatus 11 is provided with. Pressure that the pressure feeding mechanism 38 is able to apply to the liquid is preferably larger than the value of converted pressure of the water head at the supply position. The control portion 100 switches between supply of the liquid by the water head and supply of the liquid by the pressure feeding mechanism 38 by performing drive control of the pressure feeding mechanism 38 at a designated timing.

Note that, in the liquid accommodating body 20, in a case where the liquid is accommodated (filled) in the liquid accommodating portion 21 that consists of a closed bag, a "water head center" is present in the accommodated liquid. The "water head center" is equivalent to a liquid surface of the accommodated liquid in a so-called open system liquid accommodating portion in which an internal space is opened to the atmosphere. Then, the water head (energy at the position of the liquid), with respect to the nozzle 36, which is generated by the liquid accommodated in the liquid accommodating portion 21 that is disposed at the supply position is defined by a difference of height between the "water head center" and the nozzle 36.

The "water head center" is moved below in the direction of gravity when the remaining amount of the liquid that is accommodated in the liquid accommodating portion 21 becomes small in the same manner as the liquid surface of the liquid that is accommodated in the open system liquid accommodating portion. The liquid is filled into the liquid accommodating portion 21 in the unused state in the embodiment such that the "water head center" is approximately half of the height of the liquid accommodating portion 21 that is disposed at the supply position, and the maximum value of the water head is equivalent to the difference of height H in FIG. 3. Then, when the holding portion 16 that holds the liquid accommodating body 20 is at the supply position, since the liquid accommodating body 20 is disposed at a higher position than the nozzle 36, the water head center of the liquid that is accommodated in the liquid accommodating body 20 is at a higher position than the nozzle 36 and the liquid that is accommodated in the liquid accommodating body 20 is supplied to the liquid ejecting portion 33 by the water head.

The supply flow path 37 may branch into two branched flow paths 37*a* and 37*b* at the upstream side connected to the holding portion 16. In this case, the pressure feeding mechanism 38 may be provided in one branched flow path 37*a*, and a one way valve 40 that suppresses flow of the liquid upstream while permitting flow of the liquid downstream may be provided in the other branched flow path 37*b*.

Preferably, an opening/closing valve 39 is provided further upstream than the branched flow paths 37*a* and 37*b* on the supply flow path 37. The opening/closing valve 39 permits flow of the liquid when in an open valve state and regulates the flow of the liquid when in a closed valve state. Preferably, the opening/closing valve 39 is configured to be switchable between the open valve state and the closed valve state by opening/closing control of the control portion 100.

Figure 4:
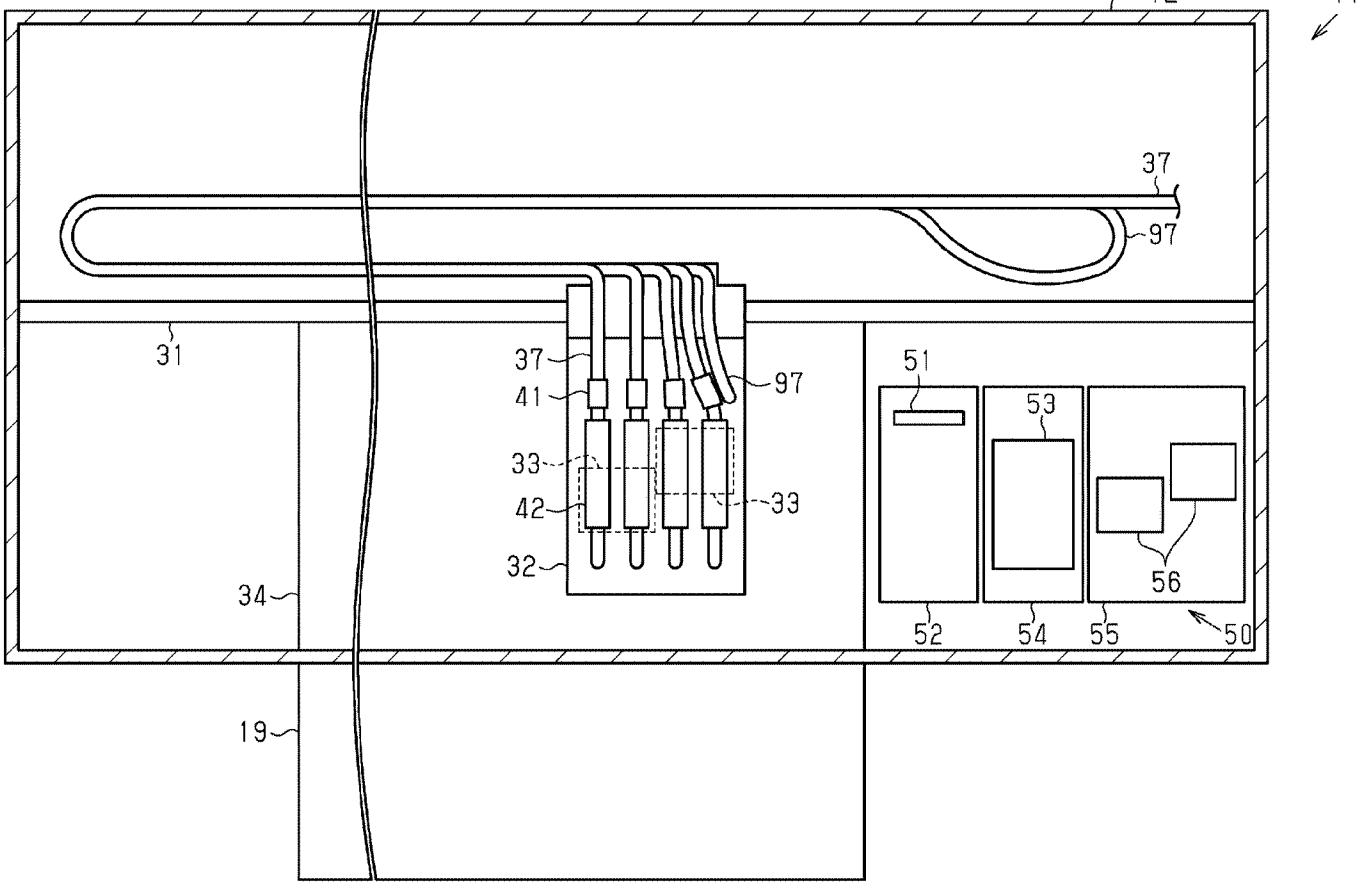
FIG. 4 is a schematic diagram illustrating a planar configuration within a casing with which the liquid ejecting apparatus in FIG. 1 is provided.

As shown in FIG. 4, the supply flow path 37 is drawn around such that an extension direction in the longitudinal direction is inverted inside the casing 12, and the downstream end of the supply flow path 37 is connected to the carriage 32.

Preferably, a filter unit 41 that captures foreign matter such as air bubbles that are mixed in the liquid is provided on the supply flow path 37. It is possible to easily perform maintenance such as replacement when the filter unit 41 is exposed to the outside the carriage 32. It is possible to reduce polarization of concentration in the liquid when a static mixer 42 (refer to FIG. 5) in which a change such as change in direction or division of the flow of the liquid occurs is provided on the supply flow path 37, for example, on the downstream side of the filter unit 41 and the like.

When the right end side in FIG. 4 is set as the starting end of outward movement of the carriage 32, a maintenance mechanism 50 that is provided to perform maintenance on the liquid ejecting portion 33 is disposed in the right side part inside the casing 12 outside the transport path. The maintenance mechanism 50 is provided with a wiping device 52 that has a wiping member 51 which wipes the liquid ejecting portion 33, a flushing unit 54 that has a liquid receiving portion 53 that receives the liquid that is ejected by the liquid ejecting portion 33, and a cleaning mechanism 55 that performs cleaning on the liquid ejecting portion 33. The wiping device 52, the flushing unit 54, and the cleaning mechanism 55 are disposed lined up in the longitudinal direction to the support portion 34.

The wiping device 52 performs wiping of the liquid ejecting portion 33 by moving the wiping member 51 relative to the liquid ejecting portion 33. The flushing unit 54 has the object of preventing or eliminating clogging of the nozzle 36, and receives flushed liquid using the liquid receiving portion 53 when performing flushing of liquid droplets from the nozzle 36. For example, it is possible to configure the liquid receiving portion 53 using a rotating endless belt.

Figure 5:
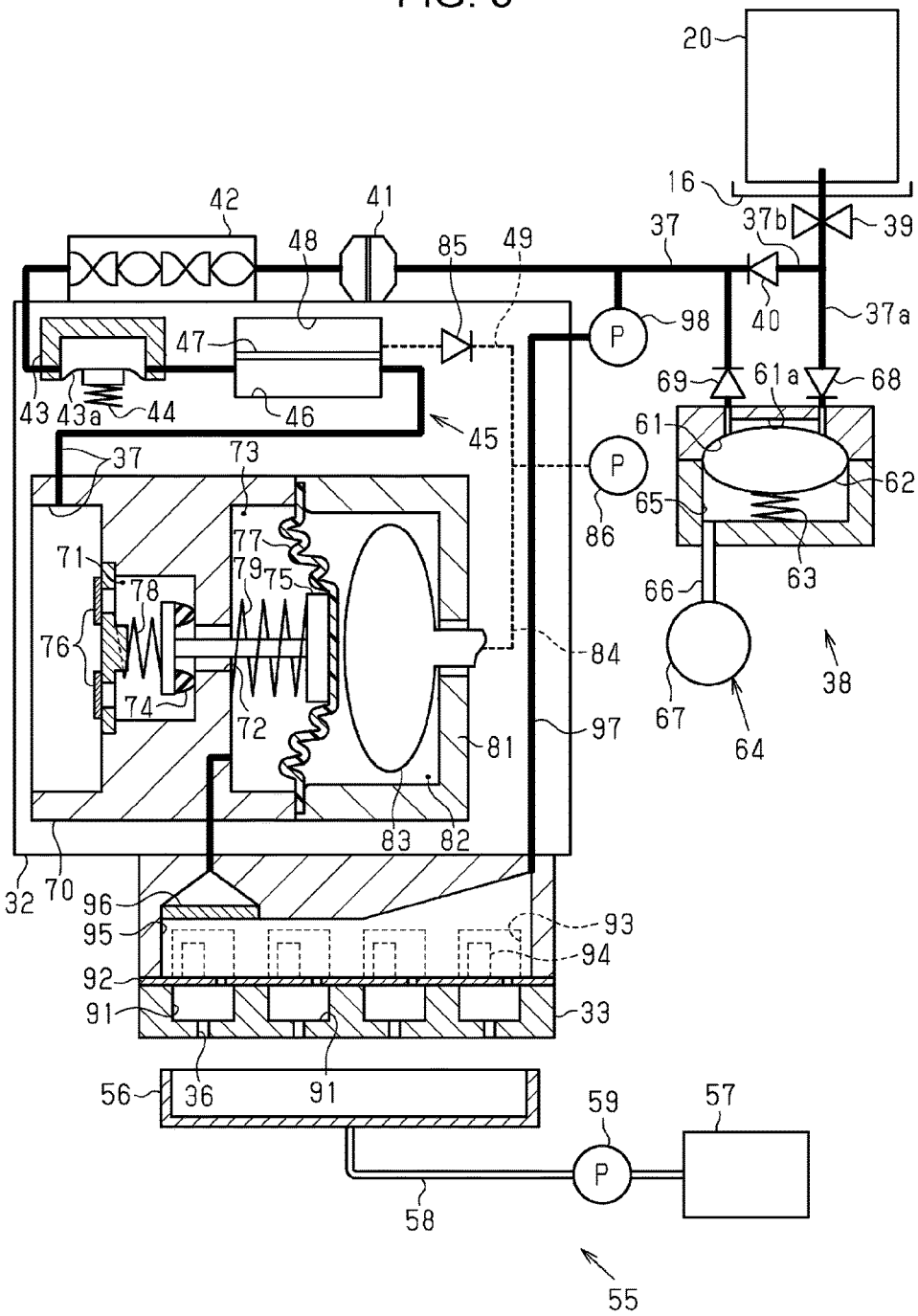
FIG. 5 is a schematic diagram illustrating a flow path configuration of the liquid ejecting apparatus in FIG. 1.

As shown in FIG. 5, the cleaning mechanism 55 is provided with a cap 56 that forms a closed space that is opened by the nozzle 36 with the liquid ejecting portion 33, a waste liquid accommodating body 57 that accommodates waste liquid, a suction flow path 58 that connects the cap 56 and the waste liquid accommodating body 57, and a suction pump 59 that is provided on the suction flow path 58. The waste liquid accommodating body 57 may be disposed outside the casing 12 (refer to FIG. 1).

The cleaning mechanism 55 performs suction cleaning in which the liquid is discharged from the nozzle 36 by generating negative pressure in the closed space by driving the suction pump 59 in a state in which the cap 56 forms the closed space. Foreign matter such as air bubbles in the liquid ejecting portion 33 and the like is discharged along with liquid by suction cleaning. The liquid that is discharged from the nozzle 36 passes through the suction flow path 58 as waste liquid and is accommodated in the waste liquid accommodating body 57.

A liquid retaining portion 43, a deaerating mechanism 45, and a pressure adjustment mechanism 70 may be provided on the supply flow path 37 that is connected to the carriage 32. On the supply flow path 37, the liquid retaining portion 43 that is provided between the opening/closing valve 39 and the pressure adjustment mechanism 70 is constituted by a flexible member 43*a* in which a part of a wall surface is able to flexibly displace, and forms a variable capacity space. The liquid retaining portion 43 retains the liquid in the variable capacity space that is applied due to biasing force of a spring 44, and mitigates variation of pressure in the liquid.

The deaerating mechanism 45 is provided with a deaerating chamber 46 that temporarily retains the liquid, a decompression chamber 48 that is partitioned into the deaerating chamber 46 and a deaerating film 47, a decompression flow path 49 that is connected to the decompression chamber 48, and a pump 86. The deaerating film 47 has a property of allowing air to pass through but not allowing the liquid to pass through, and removes air bubbles and dissolved gas that are mixed in the liquid that is retained in the deaerating chamber 46 by reducing pressure in the decompression chamber 48 through the decompression flow path 49 by driving of the pump 86.

The pressure adjustment mechanism 70 is provided with a supply chamber 71 that is provided on the supply flow path 37, a pressure chamber 73 is linkable via the supply chamber 71 and a linking hole 72, a valve body 74 that is able to open and close the linking hole 72, and a pressure receiving member 75 in which a base end side is accommodated in the supply chamber 71 and a tip end side is accommodated in the pressure chamber 73. For example, the valve body 74 consists of an elastic body that is attached to a base end part of the pressure receiving member 75 that is positioned inside the supply chamber 71. A filter 76 through which the liquid that flows into the supply chamber 71 filters may be provided on the supply flow path 37.

A part of the wall surface of the pressure chamber 73 is formed by a flexible film 77 that is able to flexibly displace. In addition, the pressure adjustment mechanism 70 is provided with a first biasing member 78 that is accommodated in the supply chamber 71, and a second biasing member 79 that is accommodated in the pressure chamber 73. The first biasing member 78 biases the valve body 74 in a direction that the linking hole 72 is closed via the pressure receiving member 75.

The pressure receiving member 75 is displaced by flexibly displacing and pressing in a direction in which the flexible film 77 reduces the capacity of the pressure chamber 73. In the valve body 74, pressure (internal pressure) that is applied to the inside surface that is the pressure chamber 73 side of the flexible film 77 is lower than pressure (external pressure) that is applied to the outside surface that is the opposite side from the pressure chamber 73 of the flexible film 77, and the valve body 74 switches from the closed valve state to the open valve state when the difference between the pressure that is applied to the inside surface and the pressure that is applied to the outside surface is a designated value (for example, 1 kPa) or more.

Note that, the predetermined value is a value that is determined according to biasing force of the first biasing member 78 and the second biasing member 79, necessary force for displacing the flexible film 77, necessary pressing force (sealing load) for closing the linking hole 72 using the valve body 74, pressure within the supply chamber 71 and pressure within the pressure chamber 73 that act on the supply chamber 71 side of the pressure receiving member 75 and the front surface of the valve body 74.

That is, the larger the biasing force of the first biasing member 78 and the second biasing member 79, the larger the predetermined value. In addition, the biasing force of the first biasing member 78 and the second biasing member 79 is set such that the pressure within the pressure chamber 73 is in a negative pressure state in a range in which it is possible to form a meniscus on the gas-liquid interface in the nozzle 36 (−1 kPa in a case where, for example, pressure that is applied to the outside surface of the flexible film 77 is atmospheric pressure).

When the linking hole 72 is open and the liquid flows into the pressure chamber 73 from the supply chamber 71, internal pressure of the pressure chamber 73 rises. Then, when the internal pressure of the pressure chamber 73 is the predetermined value described above, the valve body 74 closes the linking hole 72.

The internal pressure of the pressure chamber 73 lowers accompanying discharge of the liquid from the liquid ejecting portion 33. Then, the valve body 74 autonomously opens and closes the linking hole 72 according to the difference of pressure of external pressure (atmospheric pressure) of the pressure chamber 73 and internal pressure of the pressure chamber 73. Therefore, the pressure adjustment mechanism 70 is classified as a differential pressure valve (in particular, a decompression valve even in differential pressure valves).

An open valve mechanism 81 that supplies the liquid to the liquid ejecting portion 33 by forcibly opening the linking hole 72 may be applied to the pressure adjustment mechanism 70. For example, the open valve mechanism 81 is provided with a pressurized bag 83 that is accommodated in the accommodating chamber 82 that is partitioned into the pressure chamber 73 by the flexible film 77, and a pressurized flow path 84 along which air inside the pressurized bag 83 is caused to flow. Then, the pressurized bag 83 swells due to air that flows through the pressurized flow path 84, and the linking hole 72 is forcefully opened by flexibly displacing the flexible film 77 in a direction in which the capacity of the pressure chamber 73 is reduced. It is possible to perform pressure cleaning in which the liquid that is pressurized from the liquid ejecting portion 33 is caused to flow out by forcefully opening the linking hole 72 using the open valve mechanism 81.

In this case, the pressurized flow path 84 may be connected to the decompression flow path 49 and configured to be able to drive both pressure and decompression of the pump 86. Then, a one way valve 85 may be provided on the decompression flow path 49, air may be fed out to the pressurized bag 83 by pressurization and driving by the pump 86, and the decompression chamber 48 may be decompressed by decompression and driving by the pump 86.

The liquid ejecting portion 33 is provided with a liquid chamber 91 that is linked to the nozzle 36, an accommodating portion 93 that is partitioned into the liquid chamber 91 and a vibration plate 92, an actuator 94 that is accommodated in the accommodating portion 93, and a common liquid chamber 95 that temporarily retains the liquid that is caused to flow out from the pressure chamber 73 and supplies the liquid to a plurality of liquid chambers 91. A filter 96 that filters liquid may be disposed between the pressure chamber 73 and the common liquid chamber 95.

For example, the actuator 94 is a piezoelectric element that contracts in a case where the driving voltage is applied. After the vibration plate 92 changes shape accompanying contraction of the actuator 94, when application of the driving voltage is released, the liquid within the liquid chamber 91 with a changed capacity is ejected as liquid droplets from the nozzle 36.

At this time, when air bubbles are mixed in the nozzle 36, liquid droplets are not appropriately ejected and ejection is inadequate. In addition, in a case where foreign matter such as solid matter is clogged in the nozzle 36 or in a case where viscosity of the liquid is raised by drying and the like, ejection is inadequate. In order to prevent such inadequate ejection, it is preferable to provide the filter unit 41 or the filters 76 and 96 on the supply flow path 37, and remove foreign matter such as air bubbles.

For example, a return flow path 97 along which the liquid returns to the supply flow path 37 between the filter unit 41 and the opening/closing valve 39 may be connected to the common liquid chamber 95, and a circulation pump 98 that causes the liquid to flow from the common liquid chamber 95 toward the return flow path 97 may be disposed on the return flow path 97. According to this configuration, it is possible to capture foreign matter such as air bubbles using the filter unit 41 and the filters 76 and 96 that are on the supply flow path 37 by causing the liquid to circulate between the return flow path 97 and the supply flow path 37 due to driving of the circulation pump 98. In addition, in a case where the liquid includes a sediment component such as pigment, it is possible to uniformize the concentration by agitating the liquid by circulating the liquid and allowing the liquid to pass through the static mixer 42.

Next, the configuration of the pressure feeding mechanism 38 will be exemplified.

For example, the pressure feeding mechanism 38 is a diaphragm pump, and is provided with a pump chamber 61 that is provided on the branched flow path 37*a* that constitutes the supply flow path 37, a displaced member 62 that is constituted by a part of the wall surface of the pump chamber 61, a spring 63 that is disposed outside the pump chamber 61, and a displacement mechanism 64. The displaced member 62 is displaced in a direction in which the capacity of the pump chamber 61 increases and reduces. The spring 63 biases the displaced member 62 in a direction in which the capacity of the pump chamber 61 is reduced. However, preferably a linking groove 61*a* is provided on a part of the wall surface of the pump chamber 61 such that the liquid flows even in a state in which the capacity of the pump chamber 61 becomes minimally small due to the biasing force of the spring 63.

For example, the displacement mechanism 64 has an air chamber 65 that is partitioned into the pump chamber 61 and the displaced member 62 and a suction pump 67 that suctions the air chamber 65 through a ventilation path 66, and displaces the displaced member 62 in a direction in which the capacity of the pump chamber 61 is increased against the biasing force of the spring 63 due to driving of the suction pump 67. Note that, when the suction pump 67 stops driving, there may be a configuration such that air flows into the air chamber 65 through the ventilation path 66 and displaces the displaced member 62 in a direction in which the capacity of the pump chamber 61 is reduced due to the biasing force of the spring 63.

In addition, the pressure feeding mechanism 38 is provided with a suction valve 68 that is provided between the holding portion 16 and the pump chamber 61 and a discharge valve 69 that is provided between the pump chamber 61 and the liquid ejecting portion 33. The suction valve 68 is a one way valve that regulates flow of the liquid that flows out from the pump chamber 61 while permitting the flow of the liquid that flows into the pump chamber 61. The discharge valve 69 is a one way valve that regulates the flow of the liquid that flows into the pump chamber 61 while permitting the flow of the liquid that flows out from the pump chamber 61. Then, suction driving is performed in which the liquid flows into the pump chamber 61 due to driving by the suction pump 67 and discharge driving is performed in which the liquid flows out from the pump chamber 61 due to the biasing force of the spring 63 by stopping driving by the suction pump 67.

Next, the actions of the liquid ejecting apparatus 11 will be described along with the contents of control that is performed by the control portion 100.

The control portion 100 controls the rotation mechanism 15 and disposes the holding portion 16 in the attachment and detachment position by operation and the like of the operation portion 18 when information is input in which attachment and detachment of the liquid accommodating body 20 is performed. Thereby, the user is able to perform an attachment and detachment operation at the attachment and detachment position that is lower than the supply position.

Note that, when the holding portion 16 does not hold the liquid accommodating body 20, preferably the control portion 100 sets the opening/closing valve 39 to the closed valve state. Thereby, it is possible to suppress mixing of air bubbles to the supply flow path 37 and suppress leakage of the liquid from the supply flow path 37.

When the liquid accommodating body 20 is mounted in the holding portion 16, the control portion 100 controls the rotation mechanism 15 and disposes the holding portion 16 at the supply position by operation and the like of the operation portion 18 when an instruction is input in which a printing process is performed. Then, when the holding portion 16 that holds the liquid accommodating body 20 is at the supply position, the control portion 100 sets the opening/closing valve 39 to the open valve state. Thereby, since the liquid accommodating body 20 is disposed at a higher position than the nozzle 36, the liquid that is accommodated in the liquid accommodating body 20 is supplied to the liquid ejecting portion 33 by the water head.

When the liquid ejecting portion 33 is in a standby state in which the liquid is not ejected after the printing process, while the power source is off, and the like, preferably the control portion 100 controls the rotation mechanism 15 and disposes the holding portion 16 at the attachment and detachment position. Thereby, when in the standby state, it is possible to suppress leakage of the liquid since pressure is not applied by the water head to the inside of the supply flow path 37.

In addition, when the subsequent liquid ejecting portion 33 ejects the liquid, the liquid that is accommodated in the liquid accommodating body 20 is agitated since the rotation mechanism 15 rotates the holding portion 16 to the supply position by control of the control portion 100. Therefore, in particular, it is possible to uniformize the concentration of the liquid in a case where a component in which the liquid tends to sediment such as pigment ink that includes a pigment component is included.

Additionally, when the liquid ejecting portion 33 is set in the standby state in which the liquid is not ejected, the control portion 100 may set the opening/closing valve 39 into the open valve state. According to this configuration, the liquid flows on the supply flow path 37 that is within the arm 16*a* accompanying rotation of the holding portion 16 and the liquid is agitated by pressure variation, accompanying the flow, reaching the supply flow path 37 within the carriage 32. The pressure variation tends not to reach the liquid ejecting portion 33 since the pressure variation is mitigated by flexibly displacing the flexible member 43*a* of the liquid retaining portion 43.

However, when the liquid ejecting portion 33 is in the standby state, there is a possibility that attachment and detachment is performed accompanying replacement and the like of the liquid accommodating body 20. Therefore, preferably the opening/closing valve 39 is in the closed valve state even if the liquid ejecting portion 33 is in the standby state in a case where a sensor that detects the remaining amount in the liquid accommodating body 20 is provided and an amount of consumption of the liquid is calculated by the control portion 100, and the remaining amount in the liquid accommodating body 20 is at a near end close to zero (a state in which there is no suppliable liquid). The sensor that detects the remaining amount in the liquid accommodating body 20 may be set so as to detect the pressure variation of the supply flow path 37, and may be set such that a retention chamber that retains the liquid is provided on the supply flow path 37 and the liquid surface position of the retention chamber is detected.

After the printing process, when information is input in which the attachment and detachment of the liquid accommodating body 20 is performed by operation and the like of the operation portion 18 and when the liquid accommodating body 20 is attached and detached with respect to the holding portion 16, preferably the control portion 100 sets the opening/closing valve 39 in the closed valve state in advance of controlling the rotation mechanism 15 and rotating the holding portion 16 from the supply position to the attachment and detachment position. Thereby, after the opening/closing valve 39 is set in the closed valve state, it is possible to reliably close the opening/closing valve 39 when the liquid accommodating body 20 is attached and detached at the attachment and detachment position since the holding portion 16 moves from the supply position to the attachment and detachment position. In addition, it is possible to set the configuration such that the flow of the liquid is not reversed to the liquid accommodating body 20 accompanying rotation of the holding portion 16.

Note that, when the remaining amount of the liquid is large immediately after the liquid accommodating body 20 is replaced with a new liquid accommodating body and the like, the control portion 100 does not drive the pressure feeding mechanism 38 and supplies the liquid using the water head with respect to the nozzle 36 of the liquid that is accommodated in the liquid accommodating body 20.

When the linking groove 61*a* is provided in the pump chamber 61 of the pressure feeding mechanism 38 and the branched flow path 37*a* on which the pressure feeding mechanism 38 is disposed and the branched flow path 37*b* of another route are provided, it is possible to maintain a linked state of the supply flow path 37 between the liquid accommodating body 20 and liquid ejecting portion 33 even in the state in which the capacity of the pump chamber 61 becomes minimally small and it is possible to supply the liquid using the water head.

In a case where the liquid is accommodated in the liquid accommodating portion 21, preferably the control portion 100 drives the pressure feeding mechanism 38 to switch supply of the liquid using the pressure feeding mechanism 38 since the liquid tends not to flow out due to reaction force of the liquid accommodating portion 21 when the remaining amount of the liquid becomes small. According to this configuration, it is possible to suction the liquid within the liquid accommodating portion 21 and supply pressure to the liquid ejecting portion 33 by driving of the pressure feeding mechanism 38.

In this case, when the sensor that detects the remaining amount in the liquid accommodating body 20 is provided and the amount of consumption of the liquid is calculated by the control portion 100, it is possible to further accurately set the timing at which the control portion 100 performs switching.

In addition, the control portion 100 may switch to supply of the liquid using the pressure feeding mechanism 38 in a case where the amount of flow of the liquid that is discharged from the liquid ejecting portion 33 is larger than a predetermined threshold. For example, when suction cleaning or pressure cleaning is performed, a greater amount of the liquid is discharged from the nozzle 36 than when the liquid for the recording process is ejected. Therefore, when cleaning of the liquid ejecting portion 33 is performed, preferably the control portion 100 drives the pressure feeding mechanism 38.

Alternatively, when the amount of ejection of the liquid per unit of time is smaller than a predetermined threshold, the liquid may be supplied using only the water head and when the amount of ejection of the liquid per unit of time is the predetermined threshold described above or more, the pressure feeding mechanism 38 may be driven. By doing this, it is possible to supply the liquid due to pressure force of the pressure feeding mechanism 38 even when the amount of flow of the liquid in the supply flow path 37 becomes large and pressure loss becomes large. Otherwise, in a case where for example, ambient temperature is low, preferably liquid supply is performed by the pressure feeding mechanism 38 since viscosity of the liquid rises and the liquid tends not to flow.

According to the embodiment, it is possible to obtain the effects as above.

(1) An attachment and detachment operation of the liquid accommodating body 20 is possible at the low attachment and detachment position by changing the height of the holding portion 16 that holds the liquid accommodating body 20 at the attachment and detachment position and the supply position. Therefore, it is possible to secure a large water head without labor taken for the attachment and detachment operation becoming large.

(2) At the attachment and detachment position, the liquid within the supply flow path 37 is not pressurized since the water head center of the liquid that is accommodated in the liquid accommodating body 20 which is held in the holding portion 16 is disposed at a lower position than the nozzle 36. Therefore, unintended leakage of the liquid is suppressed by disposing the holding portion 16 at the attachment and detachment position when the liquid is not supplied.

(3) It is possible to uniformize the concentration by agitating the liquid in a case where the liquid includes the sediment component such as pigment by changing posture of the holding portion 16 accompanying rotation.

The embodiment described above may be modified as in the modification examples indicated below. In addition, the configuration that is included in the embodiments described above and the configurations that are included in the modification examples below may be arbitrarily combined and the configurations that are included in the modification examples below may be arbitrary combined with each other.

Figure 6:
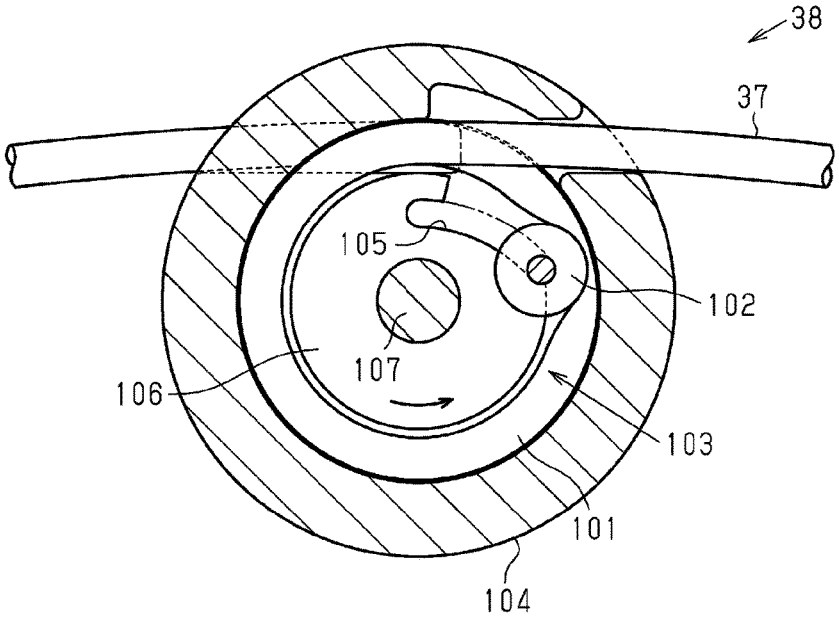
FIG. 6 is a sectional view illustrating a modification example of a pressure feeding mechanism.

As in the manner of the modification example indicated in FIG. 6, the pressure feeding mechanism 38 may be a tube pump that has a tube 101 that is able to flexibly displace and constitutes the supply flow path 37, a pressing member 102 that squashes the tube 101, and a movement mechanism 103 that moves the pressing member 102, and performs pressure feeding of the liquid by moving the pressing member 102 that squashes the tube 101 using the movement mechanism 103. The movement mechanism 103 is provided with, for example, a cylindrical shape housing 104 that accommodates the tube 101, a rotating body 106, which has a guide groove 105 that locks the pressing member 102, and that is accommodated within the housing 104, and a revolving shaft 107 that rotates due to driving force of a driving source which is not shown in the drawings. Then, the pressing member 102 is moved by rotating the rotating body 106 along with the revolving shaft 107. Note that, the right side in FIG. 6 is an upstream side of the supply flow path 37 and the left side in FIG. 6 is a downstream side of the supply flow path 37.

The guide groove 105 may be set so that the distance from the center of rotation is changed, the tube 101 is squashed when the pressing member 102 is locked to a first end distant from the center of rotation of the guide groove 105, and when the pressing member 102 comes close to the second end close to the center of rotation of the guide groove 105, squashing of the tube 101 is released. In this case, when the rotating body 106 rotates in a first direction that is indicated by an arrow in FIG. 6, the liquid within the tube 101 is subjected to pressure feeding since the pressing member 102 that is locked to the first end of the guide groove 105 moves while squashing the tube 101. In addition, when the rotating body 106 rotates in a second direction that is an opposite direction from the first direction, the liquid is not pressure fed since the pressing member 102 moves in the second end of the guide groove 105 and the squashing of the tube 101 is released.

In this case, the control portion 100 may control the movement mechanism 103 and release squashing of the tube 101 by the pressing member 102 when supply of the liquid by the pressure feeding mechanism 38 that is a tube pump is switched to supply of the liquid by the water head. According to this configuration, even in a case where pressure feeding of the liquid by the tube pump is not performed, it is possible to maintain the linked state of the supply flow path 37 between the liquid accommodating body 20 and liquid ejecting portion 33 and it is possible to supply the liquid using the water head.

The opening/closing valve 39 is mechanically interlinked with the rotation operation of the rotation mechanism 15 regardless of control of the control portion 100, and may be set to be in the open valve state when the holding portion 16 is disposed at the supply position and may be set to be in the closed valve state when the holding portion 16 is disposed at the attachment and detachment position.

The introducing portion 16*c*, the supply flow path 37, the opening/closing valve 39, the liquid retaining portion 43, the deaerating mechanism 45, or the pressure adjustment mechanism 70 may be a part of the constituent elements of the liquid supply device 14 that supplies the liquid to the liquid ejecting portion 33. In addition, the liquid supply device 14 may be configured so as to be mounted to be attachable and detachable with respect to the casing 12. In this case, the control portion that controls the rotation mechanism 15 and the like that constitutes the liquid supply device 14 may be provided in the liquid supply device 14. In addition, the liquid supply device 14 that is mounted to be attachable and detachable with respect to the casing 12 may be provided with the opening/closing valve 39.

The holding portion 16 may be configured so as to be movable, other than to the attachment and detachment position and the supply position, to the standby position at which the holding portion 16 is disposed when the liquid ejecting portion 33 is set in the standby state at which the liquid is not ejected. For example, it is possible to set the standby position on the movement path from the attachment and detachment position toward the supply position.

Figure 7:
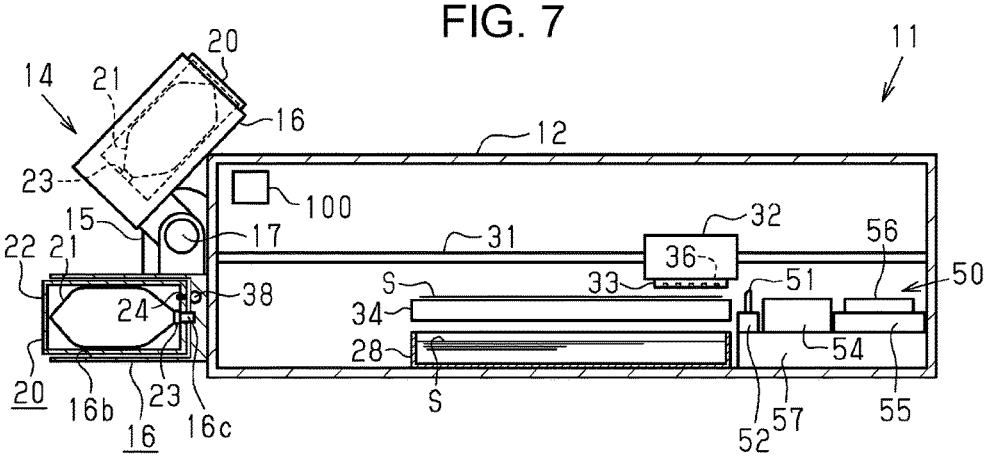
FIG. 7 is a sectional view illustrating a modification example of a liquid supply device and a liquid ejecting apparatus.

As in the manner of the modification example indicated in FIG. 7, the pressure feeding mechanism 38 may pressurize the liquid within the liquid accommodating body 20 and cause the liquid to flow out on the supply flow path 37 by pressurized air flowing out through the air supply path 24 in the liquid accommodating body 20 (for example, a space between the case 22 and the liquid accommodating portion 21) that is mounted in the holding portion 16.

As in the manner of the modification example indicated in FIG. 7, for example, the pressure feeding mechanism 38 is included in the liquid supply device 14, and it is also possible to dispose the pressure feeding mechanism 38 outside the casing 12.

In the manner of the liquid accommodating body 20 that is held in the holding portion 16 that is indicated shown from a side surface in the modification example in FIG. 7, the lead-out portion 23 and the liquid accommodating portion 21 may be lined up diagonally with respect to the horizontal plane at the supply position. In the same manner, the lead-out portion 23 and the liquid accommodating portion 21 may be lined up diagonally with respect to the horizontal plane at the attachment and detachment position.

As indicated in sectional view in the modification example in FIG. 7, the lead-out portion 23 and the liquid accommodating portion 21 may be lined up horizontally at the attachment and detachment position. In addition, the liquid accommodating body 20 may be moved horizontally and attached to and detached from the holding portion 16.

As in the modification example indicated in FIG. 7, the liquid ejecting apparatus 11 may not be provided with the support leg portion 13. In addition, instead of the feeding mechanism 25, the winding mechanism 26, and the tension bar 27, the liquid ejecting apparatus 11 may mount, to be attachable and detachable, the cassette 28 that accommodates the medium S which is a single slip of paper that is cut to a predetermined size.

As in the modification example indicated in FIG. 7, the rotary shaft 17 may also be extended in a direction (transport direction of the medium S on the support portion 34 in FIG. 7) that intersects with the longitudinal direction (left and right direction in FIG. 7) of the casing 12.

As in the modification example indicated in FIG. 7, it is possible to arbitrarily modify the length of the arm 16*a* of the holding portion 16. In addition, the holding portion 16 may not be provided with the arm 16*a*.

The liquid supply device 14 or the liquid ejecting apparatus 11 may not be provided with the pressure feeding mechanism 38, and the liquid may be supplied to the liquid ejecting portion 33 by only the water head.

The height of the holding portion 16 that holds the liquid accommodating body 20 may be changed at the attachment and detachment position and the supply position without changing the posture of the holding portion 16. For example, the holding portion 16 may not be provided with the arm 16*a* and a holder movement mechanism that holds the holder 16*b* may be provided in the casing 12 such that the holder 16*b* slidably moves to the upper supply position at which the posture of the attachment and detachment position in FIG. 3 is maintained without any changes. It is possible to adopt a mechanism that moves the holder 16*b* by fixing the holder 16*b* to the belt that is wound on a pair of rotating rollers that is provided in the casing 12 and rotating the rotation rollers, a mechanism that moves the holder 16*b* by winding and feeding a long member on which the holder 16*b* is hung, a mechanism using a rack and pinion using a rack that is provided on the holder 16*b* side and a pinion that is provided in the casing 12, a linking mechanism that connects the holder 16*b* and the casing 12 using a plurality of links, and the like as the holder movement mechanism.

The liquid that is ejected by the liquid ejecting portion 33 is not limited to ink, and for example, particles of the functional material may be a liquid body and the like that is dispersed or mixed in the liquid. For example, there may be a configuration in which recording is performed by ejecting a liquid form body including, in a dispersed or dissolved form, material such as an electrode material or color material (pixel material) which are used in manufacture and the like of a liquid crystal display, an electro-luminescence (EL) display, and a surface light emission display.

The medium S is not limited to a paper sheet, and may be a plastic film, thin plate material, and the like, and may be a fabric which is used in a printing apparatus and the like. In addition, the medium S may be clothing and the like of an arbitrary shape such as a T-shirt, and may be a three-dimensional object with an arbitrary shape such as tableware or stationery.

Hereinafter, technical concepts and the actions and effects thereof that are ascertained from the embodiments and the modification examples described above will be described.

Concept 1

A liquid supply device that supplies liquid to a liquid ejecting portion that ejects the liquid from a nozzle, including:

a holding portion that holds, to be attachable and detachable, a liquid accommodating body that accommodates the liquid;

a rotation mechanism that rotates the holding portion between an attachment and detachment position at which the liquid accommodating body is attached and detached and a supply position at which the liquid is supplied to the liquid ejecting portion, in which the liquid accommodating body that is held in the holding portion at the supply position is disposed at a higher position than the nozzle, and the liquid accommodating body that is held in the holding portion at the attachment and detachment position is disposed at a lower position than the nozzle.

According to Concept 1, when the holding portion is at the supply position, since the liquid accommodating body is disposed at a higher position than the nozzle, it is possible to supply the liquid to the liquid ejecting portion using a water head of the liquid that is accommodated in the liquid accommodating body and the nozzle. In addition, when the holding portion is at the attachment and detachment position, since the liquid accommodating body is disposed at a lower position than the nozzle, it is possible to more easily perform an attachment and detachment operation than attachment and detachment at the supply position. Accordingly, it is possible to reduce labor that is taken for the attachment and detachment operation of the liquid accommodating body that is mounted at a position at which it is possible to supply liquid using the water head.

Concept 2

The liquid supply device according to Concept 1, in which the liquid accommodating body has a liquid accommodating portion that accommodates the liquid and a lead-out portion that leads out the liquid from the liquid accommodating portion, and a positional relationship of the lead-out portion and the liquid accommodating portion is inverted up and down in the liquid accommodating body that is held in the holding portion when the holding portion is at the supply position and when the holding portion is at the attachment and detachment position.

According to Concept 2, the liquid accommodating body is able to agitate the liquid that is accommodated in the liquid accommodating portion accompanying rotation of the holding portion since the positional relationship of the lead-out portion and the liquid accommodating portion is inverted up and down when the holding portion is at the supply position and when the holding portion is at the attachment and detachment position.

Concept 3

The liquid supply device according to Concept 2, in which in the liquid accommodating body that is held in the holding portion at the attachment and detachment position, the lead-out portion is disposed on the liquid accommodating portion.

According to Concept 3, when the holding portion is at the attachment and detachment position, the liquid that is accommodated in the liquid accommodating portion tends not to leak from the lead-out portion during the attachment and detachment operation of the liquid accommodating body since the lead-out portion of the liquid accommodating body is disposed on the liquid accommodating portion.

Concept 4

The liquid supply device according to any one of Concept 1 to Concept 3, including an introducing portion that is connected such that it is possible to lead out the accommodated liquid with respect to the liquid accommodating body that is held in the holding portion;

a supply flow path for causing the liquid to flow from the introducing portion toward the liquid ejecting portion;

an opening/closing valve that is switchable between an open valve state in which flow of the liquid is permitted and a closed valve state in which flow of the liquid is regulated on the supply flow path; and a pressure adjustment mechanism that is provided between the opening/closing valve and the liquid ejecting portion on the supply flow path and that adjusts pressure of the liquid which is supplied to the liquid ejecting portion.

According to Concept 4, it is possible to supply the liquid toward the liquid ejecting portion by setting the opening/closing valve to the open valve state, and it is possible to stop supply of the liquid to the liquid ejecting portion by setting the opening/closing valve to the closed valve state. In addition, it is possible to adjust pressure of the liquid that is supplied to the liquid ejecting portion using the pressure adjustment mechanism.

Concept 5

The liquid supply device according to Concept 4, in which the opening/closing valve is interlinked with the rotation operation of the rotation mechanism, is in the open valve state when the holding portion is disposed at the supply position and is in the closed valve state when the holding portion is disposed at the attachment and detachment position.

According to Concept 5, the opening/closing valve is interlinked with the rotation operation of the rotation mechanism and the liquid tends not to leak during attachment and detachment of the liquid accommodating body by setting the opening/closing valve to the closed valve state when the holding portion is disposed at the attachment and detachment position. In addition, the opening/closing valve is interlinked with the rotation operation of the rotation mechanism and it is possible to rapidly supply the liquid from the mounted liquid accommodating body toward the liquid ejecting portion by setting the opening/closing valve to the open valve state when the holding portion is disposed at the supply position. In addition, it is possible to set the configuration such that the flow of the liquid is not reversed to the liquid accommodating body accompanying rotation of the holding portion by interlinking the opening/closing operation of the opening/closing valve with the rotation operation of the rotation mechanism.

Concept 6

The liquid supply device according to any one of Concept 1 to Concept 4, including:

a control portion that controls the constituent elements of the liquid supply device, in which the control portion controls the rotation mechanism and disposes the holding portion at the attachment and detachment position when the liquid ejecting portion is in a standby state in which the liquid is not ejected.

According to Concept 6, it is possible to set such that the liquid is not in a pressurized state due to the water head when supply of the liquid is unnecessary since the rotation mechanism disposes the holding portion at the attachment and detachment position when the liquid ejecting portion is in the standby state in which the liquid is not ejected.

Concept 7

The liquid supply device according to Concept 6, including:

an introducing portion that is connected such that it is possible to lead out the accommodated liquid with respect to the liquid accommodating body that is held in the holding portion;

a supply flow path for causing the liquid to flow from the introducing portion toward the liquid ejecting portion; and an opening/closing valve that is switchable between an open valve state in which flow of the liquid is permitted and a closed valve state in which flow of the liquid is regulated on the supply flow path, and in which the control portion sets the opening/closing valve to the closed valve state when the holding portion does not hold the liquid accommodating body, sets the opening/closing valve to the open valve state when the holding portion that holds the liquid accommodating body is at the supply position, and sets the opening/closing valve to the closed valve state in advance of rotating the holding portion from the supply position to the attachment and detachment position when the liquid accommodating body is attached and detached with respect to the holding portion.

According to Concept 7, it is possible to suppress leakage of the liquid since the opening/closing valve is in the closed valve state when the holding portion does not hold the liquid accommodating body. In addition, it is possible to supply the liquid that is accommodated in the liquid accommodating body to the liquid ejecting portion since the opening/closing valve is in the open valve state when the holding portion that holds the liquid accommodating body is at the supply position. In addition, it is possible to suppress leakage of the liquid accompanying attachment and detachment of the liquid accommodating body since the opening/closing valve is in the closed valve state in advance of the holding portion rotating from the supply position to the attachment and detachment position when the liquid accommodating body is attached and detached with respect to the holding portion.

Concept 8

The liquid supply device according to Concept 6 or Concept 7, including:

an introducing portion that is connected such that it is possible to lead out the accommodated liquid with respect to the liquid accommodating body that is held in the holding portion;

a supply flow path for causing liquid to flow from the introducing portion toward the liquid ejecting portion;

an opening/closing valve that is switchable between an open valve state in which flow of the liquid is permitted and a closed valve state in which flow of the liquid is regulated on the supply flow path;

a pressure adjustment mechanism that is provided between the opening/closing valve and the liquid ejecting portion on the supply flow path and that adjusts pressure of the liquid which is supplied to the liquid ejecting portion; and a liquid retaining portion that retains the liquid between the opening/closing valve and the pressure adjustment mechanism on the supply flow path, in which a part of the wall surface of the liquid retaining portion is configured by a flexible member that is able to flexibly displace, and the control portion sets the opening/closing valve to the open valve state when the liquid ejecting portion is in a standby state in which the liquid is not ejected.

According to Concept 8, the liquid is permitted to flow in and flow out the liquid retaining portion since the opening/closing valve is in the open valve state when the liquid ejecting portion is in the standby state in which the liquid is not ejected. Then, it is possible to agitate the liquid accompanying flow of the liquid in the liquid retaining portion.

Concept 9

A liquid ejecting apparatus including:

a liquid ejecting portion that has a nozzle and ejects liquid from the nozzle;

a holding portion in which the liquid accommodating body that accommodates the liquid is mounted, to be attachable and detachable; and a rotation mechanism that rotates the holding portion between an attachment and detachment position at which the liquid accommodating body is attached and detached and a supply position at which the liquid is supplied to the liquid ejecting portion, in which the liquid accommodating body that is held in the holding portion at the supply position is disposed at a higher position than the nozzle, and the liquid accommodating body that is held in the holding portion at the attachment and detachment position is disposed at a lower position than the nozzle.

According to Concept 9, it is possible to obtain the same actions and effects as the liquid supply device of Concept 1.

The entire disclosure of Japanese Patent Application No. 2016-158439, filed Aug. 12, 2016 is expressly incorporated by reference herein.

What is claimed is:

1. A liquid supply device that supplies liquid to a liquid ejecting portion that ejects liquid from a nozzle, comprising:

a holding portion that holds, to be attachable and detachable, a liquid accommodating body that accommodates the liquid; and a rotation mechanism that rotates the holding portion between an attachment and detachment position at which the liquid accommodating body is attached and detached and a supply position at which the liquid is supplied to the liquid ejecting portion, wherein the liquid accommodating body that is held in the holding portion at the supply position is disposed at a higher position than the nozzle, and the liquid accommodating body that is held in the holding portion at the attachment and detachment position is disposed at a lower position than the nozzle.

2. The liquid supply device according to claim 1, wherein the liquid accommodating body has a liquid accommodating portion that accommodates the liquid and a lead-out portion that leads out the liquid from the liquid accommodating portion, and a positional relationship of the lead-out portion and the liquid accommodating portion is inverted up and down in the liquid accommodating body that is held in the holding portion when the holding portion is at the supply position and when the holding portion is at the attachment and detachment position.

3. The liquid supply device according to claim 2, wherein in the liquid accommodating body that is held in the holding portion at the attachment and detachment position, the lead-out portion is disposed on the liquid accommodating portion.

4. The liquid supply device according to claim 1, further comprising:

an introducing portion that is connected such that it is possible to lead out the accommodated liquid with respect to the liquid accommodating body that is held in the holding portion;

a supply flow path provided so as to allow the liquid to flow from the introducing portion toward the liquid ejecting portion;

an opening/closing valve that is switchable between an open valve state in which flow of the liquid is permitted and a closed valve state in which flow of the liquid is regulated on the supply flow path; and a pressure adjustment mechanism that is provided between the opening/closing valve and the liquid ejecting portion on the supply flow path and that adjusts pressure of the liquid which is supplied to the liquid ejecting portion.

5. The liquid supply device according to claim 4, wherein the opening/closing valve is interlinked with the rotation operation of the rotation mechanism, is in the open valve state when the holding portion is disposed at the supply position and is in the closed valve state when the holding portion is disposed at the attachment and detachment position.

6. The liquid supply device according to claim 1, further comprising:

a control portion that controls the constituent elements of the liquid supply device, wherein the control portion controls the rotation mechanism and disposes the holding portion at the attachment and detachment position when the liquid ejecting portion is in a standby state in which the liquid is not ejected.

7. The liquid supply device according to claim 6, further comprising:

an introducing portion that is connected such that it is possible to lead out the accommodated liquid with respect to the liquid accommodating body that is held in the holding portion;

a supply flow path provided so as to allow the liquid to flow from the introducing portion toward the liquid ejecting portion; and an opening/closing valve that is switchable between an open valve state in which flow of the liquid is permitted and a closed valve state in which flow of the liquid is regulated on the supply flow path, wherein the control portion sets the opening/closing valve to the closed valve state when the holding portion does not hold the liquid accommodating body, sets the opening/closing valve to the open valve state when the holding portion that holds the liquid accommodating body is at the supply position, and sets the opening/closing valve to the closed valve state in advance of rotating the holding portion from the supply position to the attachment and detachment position when the liquid accommodating body is attached and detached with respect to the holding portion.

8. The liquid supply device according to claim 6, further comprising:

an introducing portion that is connected such that it is possible to lead out the accommodated liquid with respect to the liquid accommodating body that is held in the holding portion;

a supply flow path provided so as to allow the liquid to flow from the introducing portion toward the liquid ejecting portion;

an opening/closing valve that is switchable between an open valve state in which flow of the liquid is permitted and a closed valve state in which flow of the liquid is regulated on the supply flow path;

a pressure adjustment mechanism that is provided between the opening/closing valve and the liquid ejecting portion on the supply flow path and that adjusts pressure of the liquid which is supplied to the liquid ejecting portion; and a liquid retaining portion that retains the liquid between the opening/closing valve and the pressure adjustment mechanism on the supply flow path, wherein a part of the wall surface of the liquid retaining portion is configured by a flexible member that is able to flexibly displace, and the control portion sets the opening/closing valve in the open valve state when the liquid ejecting portion is in the standby state in which the liquid is not ejected.

9. The liquid supply device according to claim 1, wherein the liquid accommodating body that is held in the holding portion at the attachment and detachment position is disposed at a lower position than the nozzle.

10. A liquid ejecting apparatus comprising:

a liquid ejecting portion that has a nozzle and ejects liquid from the nozzle;

a holding portion in which the liquid accommodating body that accommodates the liquid is mounted, to be attachable and detachable; and a rotation mechanism that rotates the holding portion between an attachment and detachment position at which the liquid accommodating body is attached and detached and a supply position at which the liquid is supplied to the liquid ejecting portion, wherein the liquid accommodating body that is held in the holding portion at the supply position is disposed at a higher position than the nozzle.

11. The liquid ejecting apparatus according to claim 10, wherein the liquid accommodating body that is held in the holding portion at the attachment and detachment position is disposed at a lower position than the nozzle.

* * * * *